US010784593B1

(12) United States Patent
Sims, III

(10) Patent No.: US 10,784,593 B1
(45) Date of Patent: Sep. 22, 2020

(54) DUAL-BAND AND WIDEBAND PATCH ANTENNA

(71) Applicant: The United States of America as represented by the Administrator of NASA, Washington, DC (US)

(72) Inventor: William Herbert Sims, III, New Market, AL (US)

(73) Assignee: United States of America as represented by the Administrator of the National Aeronautics and Space Administration, Washington, DC (US)

( * ) Notice: Subject to any disclaimer, the term of this patent is extended or adjusted under 35 U.S.C. 154(b) by 187 days.

(21) Appl. No.: 16/053,422

(22) Filed: Aug. 2, 2018

(51) Int. Cl.

| | |
|---|---|
| ***H01Q 21/30*** | (2006.01) |
| ***H01Q 1/52*** | (2006.01) |
| ***H01Q 9/04*** | (2006.01) |
| ***H01Q 21/00*** | (2006.01) |

(52) U.S. Cl.
CPC ..... *H01Q 21/30* (2013.01); *H01Q 1/523* (2013.01); *H01Q 9/0414* (2013.01); *H01Q 21/0075* (2013.01)

(58) Field of Classification Search
CPC ..... H01Q 1/52; H01Q 1/521; H01Q 1/523; H01Q 5/50; H01Q 9/0407; H01Q 9/0414; H01Q 9/0442; H01Q 9/045; H01Q 21/006; H01Q 21/0075; H01Q 21/0081; H01Q 21/08; H01Q 21/30
See application file for complete search history.

(56) References Cited

U.S. PATENT DOCUMENTS

| | | | | |
|---|---|---|---|---|
| 4,827,271 | A | 5/1989 | Bemeking et al. | |
| 5,990,838 | A * | 11/1999 | Burns | H01Q 1/38 343/702 |
| 6,118,406 | A | 9/2000 | Josypenko | |
| 6,307,525 | B1 * | 10/2001 | Bateman | H01Q 1/246 333/126 |
| 6,639,558 | B2 | 10/2003 | Kellerman et al. | |
| 6,801,165 | B2 | 10/2004 | Fang | |
| 7,099,686 | B2 * | 8/2006 | Ro | H01Q 9/0414 343/700 MS |

* cited by examiner

*Primary Examiner* — Robert Karacsony
(74) *Attorney, Agent, or Firm* — James J. McGroary; Helen M. Galus

(57) ABSTRACT

A dual-band patch antenna includes a first patch antenna for operation at a first frequency and a second patch antenna for operation at a second frequency that is an integer multiple of the first frequency. A dielectric support is provided on which the first and second patch antennas are mounted. A nearest distance defined between the first and second patch antennas is a function of the second frequency and a dielectric constant of the dielectric support. The dielectric support has a feed point adapted to have a transmission line electrically coupled thereto. Electrically-conducting paths are coupled to the dielectric support for electrically coupling the feed point to the first and second patch antennas where at least one such electrically-conducting path has an insertion loss that is greater than 0 dB and less than or equal to 3 dB.

12 Claims, 2 Drawing Sheets

DUAL-BAND AND WIDEBAND PATCH ANTENNA

ORIGIN OF THE INVENTION

The invention described herein was made by an employee of the United States Government and may be manufactured and used by or for the Government of the United States of America for governmental purposes without the payment of any royalties thereon or therefor.

BACKGROUND OF THE INVENTION

1. Field of the Invention

This invention relates to patch antennas. More specifically, the invention is a patch antenna providing wideband operation at a first frequency and at a second frequency that is an integer multiple of the first frequency.

2. Description of the Related Art

A variety of airborne and orbital platforms utilize patch antennas owing to their low cost, light weight, ability to be constructed for multiple polarizations, and ease of mounting to rigid surfaces. However, patch antennas have a limited bandwidth that is typically on the order of 5% or less than the antenna's resonant frequency. Furthermore, if a patch antenna needs to support multiple frequencies of operation, the size of the overall antenna assembly must be significantly increased in order to prevent interference between the frequencies of operation. This ultimately adds to the size, weight, and cost of the patch antenna.

SUMMARY OF THE INVENTION

Accordingly, it is an object of the present invention to provide a dual-band patch antenna that can provide wideband operation for each of the antenna's hands.

Other objects and advantages of the present invention will become more obvious hereinafter in the specification and drawings.

In accordance with the present invention, a dual-band patch antenna includes a first patch antenna for operation at a first frequency and a second patch antenna for operation at a second frequency that is an integer multiple of the first frequency. A dielectric support is provided on which the first patch antenna and second patch antenna are mounted. A nearest distance defined between the first patch antenna and second patch antenna is a function of the second frequency and a dielectric constant of the dielectric support. The dielectric support has a feed point adapted to have a transmission line electrically coupled thereto. Electrically-conducting paths are coupled to the dielectric support for electrically coupling the feed point to the first patch antenna and second patch antenna. At least one of the electrically-conducting paths has an insertion loss that is greater than 0 dB and less than or equal to 3 dB.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
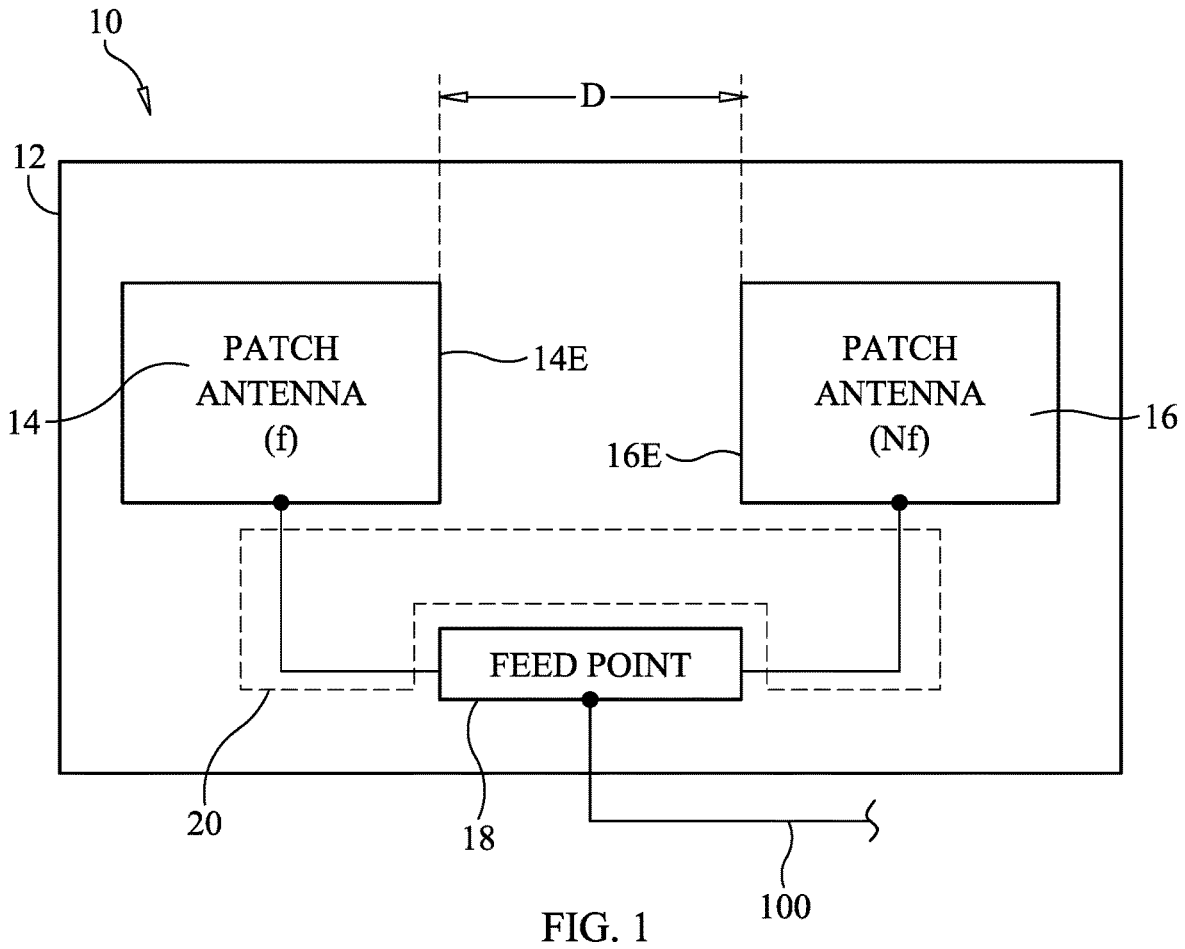
FIG. 1 is a top-level schematic view of a dual-band and wideband patch antenna assembly in accordance with the present invention.

Referring now to the drawings and more particularly to FIG. 1, a dual-band and wide band patch antenna assembly in accordance with the present invention is illustrated schematically, is referenced generally by numeral 10, and will be referred to hereinafter simply as patch antenna 10. It is to be understood that the illustrated patch antenna 10 provides a simple presentation of the features of the present invention to facilitate a description of the features. That is and as will be understood by one of the ordinary skill in the art, the realization of the antenna's described features can be achieved in a variety of ways without departing from the scope of the present invention. For example, and as will be described later herein, patch antennas incorporating the features of the present invention can be realized using multi-layer, printed circuit board constructions.

Patch antenna 10 includes a dielectric support structure 12 that provides the physical support for a first patch antenna 14 and a second patch antenna 16. For purposes of the present invention, patch antenna 14 has a resonant frequency "f" and patch antenna 16 has a resonant frequency "Nf" where the value of "N" is a whole number or integer. Patch antennas 14 and 16 are spaced apart from one another such that a distance "D" is defined between edges 14E and 16E, respectively, that are nearest to one another. In accordance with the present invention, distance D is a function of the higher resonant frequency Nf and the dielectric constant "κ" of the dielectric material used for support structure 12. In general, distance D is ideally the minimum distance that will allow patch antennas 14 and 16 to each operate without radiation interference there between. More specifically, distance D is equal to $(\lambda/2)/(\kappa)^{1/2}$ where λ is the wavelength of the higher resonant frequency Nf (e.g., in meters).

Patch antenna 10 also has electrical connector or feed point 18 provided on dielectric support structure 12 with feed point 18 serving as the electrical attachment point for an RF transmission line 100. It is to be understood that transmission line 100 is not part of the present invention. The electrical coupling of feed point 18 to patch antennas 14 and 16 is provided by a system or arrangement of electrically-conducting paths that are represented generally on patch antenna 10 by the path lines contained within a dashed-line box referenced by numeral 20. For the remainder of the description, the electrically-conducting paths will be referred to simply as "electrical paths 20".

As will be explained further below, wideband operation of patch antennas 14 and 16 is provided for when each of the various portions of electrical paths 20 include an insertion loss "L" that is greater than 0 dB but less than or equal to 3 dB. In general, the physical dimensions of the electrical conductors (e.g., electrical traces in terms of printed circuit board constructions) are designed to provide the needed insertion loss for wideband operation. The amount of insertion loss in the above-referenced range will be dependent on the operational requirements of a particular application.

Figure 2:
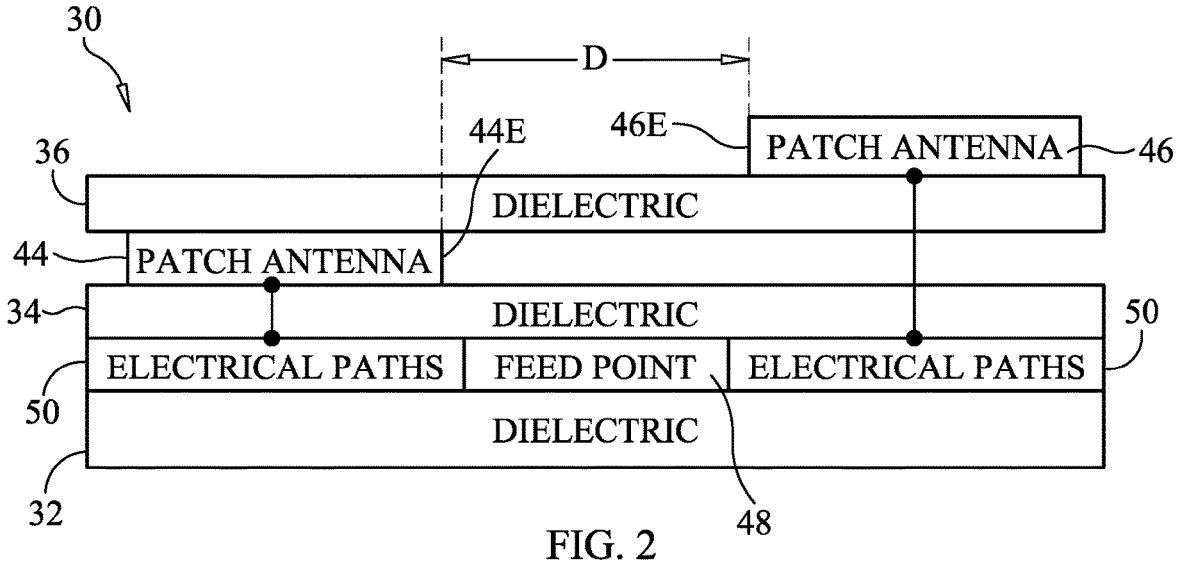
FIG. 2 is a cross-sectional schematic view of a multi-layer dual-band and wideband patch antenna assembly in accordance with an embodiment of the present invention.
Figure 3:
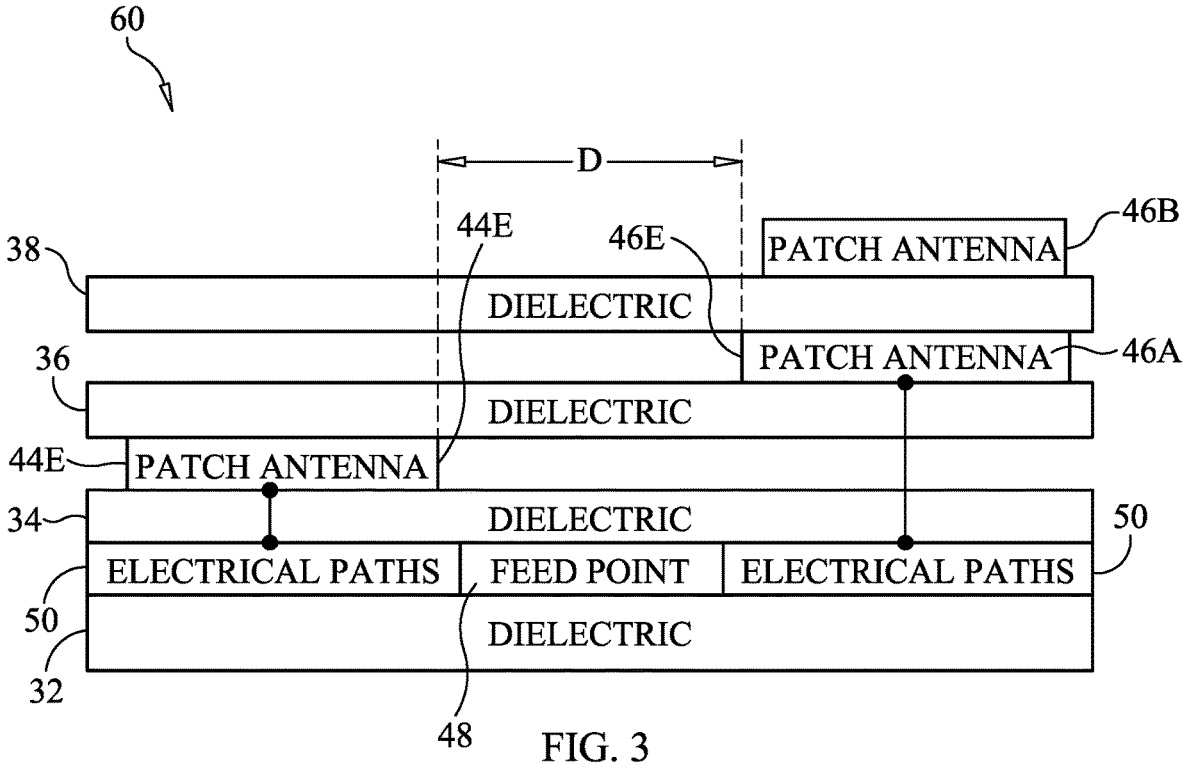
FIG. 3 is a cross-sectional schematic view of a multi-layer, stacked-patch, dual-band and wideband patch antenna assembly in accordance with another embodiment of the present invention.

As mentioned above, patch antennas in accordance with the present invention can be realized multi-layer constructions thereof. By way of illustrative examples, two multi-layer embodiments of the present invention are shown in FIGS. 2 and 3. In each of the illustrations, the gaps or spaces between some layers are used simply to maintain clarity in the drawings and would not be present in actual constructions as would be well-understood by one of ordinary skill in the art.

Referring first to FIG. 2, a patch antenna 30 in accordance with the present invention includes multiple layers (e.g., layers 32, 34 and 36) of a dielectric material, the choice of which can include but is not limited to fiberglass (e.g., FR4), alumina, TEFLON, or other well-known dielectric materials. Interleaved with portions of the dielectric layers are patch antennas 44 and 46 that lie on parallel planes of patch antenna 30. As described earlier herein, a distance D between the nearest edges 44E and 46E of patch antennas 44 and 46, respectively, is defined by the wavelength of the highest resonant frequency (between patch antennas 44 and 46) and the dielectric constant of the material used for layer 32, 34 and 36.

The base layer 32 of dielectric material provides the support for an RF feed point 48 (i.e., analogous to the above-described feed point 18) and electrical paths 50 (i.e., analogous to the above-described electrical paths 20) used to electrically couple feed point 48 to each of patch antennas 44 and 46. As mentioned above, each of the various portions of electrical paths 50 incorporate an insertion loss that provides for wideband operation of each patch antenna 44 and 46. The insertion losses serve to "de-Q" each patch antenna thereby increasing operational bandwidth of each patch antenna. The added insertion loss L satisfying the relationship $$0\ \text{dB} < L \leq 3\ \text{dB}$$

provides for a Voltage Standing Wave Ratio (VSWR) mismatch that de-Qs the patch antenna coupled to its electrical path leading to feed point 48. Since the dielectric constant of the dielectric material used for layers 32, 34 and 36 is fixed, the added insertion loss is achieved through adjustment of the physical dimensions (i.e., length, width, and/or thickness) of the conductors/traces used for electrical paths 50. Since the physical dimensions of electrical paths 50 define the characteristic impedance thereof, design of electrical paths 50 is achieved by determining the characteristic impedance of each portion of electrical paths 50 that includes the desired amount of insertion loss L, and then determining the physical dimensions of each electrical path portion using well-known transmission line theory.

To achieve the VSWR mismatch that provides the desired insertion losses, the following equation is used to determine the reflection coefficient Γ where $$L = -10 \log(1-\Gamma^2)$$

and where L is the selected value of insertion loss in dB. To determine the VSWR (and hence the impedance of each portion of electrical paths 50), the following relationship is used $$\Gamma = (R-Z_0)^{1/2}(R-Z_0)^{-1/2}$$

where $Z_0$ is the desired characteristic impedance of the entirety of electrical paths 50, and R is the impedance of transmission line 100. Each section of electrical paths 50 needs to be calculated to achieve the desired off-nominal impedance in ohms (e.g., typically 50, 75, 100, etc.) to achieve the desired insertion loss for overall de-Q'ing of the circuit. It is to be understood that a variety of methods can be employed to determine where the insertion loss will be installed without departing from the scope of the present invention. For example, the insertion loss could be installed in the first or final one of electrical paths 50, could be installed using an equal or random distribution scheme throughout all of electrical paths 50, or installed in accordance with other distribution schemes.

The present invention is not limited to single-patch types of patch antennas. That is, one or both of the lower and integer-multiple higher resonant frequency patch antennas in the present invention could be realized by a stacked patch antenna to provide for increased operational bandwidth. For example, and as illustrated in FIG. 3, a patch antenna 60 in accordance with the present invention includes dielectric layers 32/34/36/38, patch antenna 44, and a stacked patch antenna defined by the stacked arrangement of patch antennas 46A and 46B. As would be understood by one of ordinary skill in the art, a stacked patch antenna can comprise more than two patches without departing from the scope of the present invention. In the illustrated example, the largest-area and lowest resonant frequency for the stacked patch antenna is defined by patch antenna 46A. That is, patch antenna 46B has a smaller area and higher resonant frequency than patch antenna 46A. Patch antenna 46B is centered over patch antenna 46A such that the nearest edge of the stacked patch antenna 46A/46B for purposes of defining distance D is defined by edge 46E of patch antenna 46A.

The advantages of the present invention are numerous. The patch antenna assembly provides for both dual-band and wideband operation in a package that can be minimized yet still provide interference free operation between the two bands. The introduction of insertion losses provides the means to increase the bandwidth of both operational bands. The combination of these features will improve the cost, weight, and operational performance of dual-band patch antennas.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A patch antenna, comprising:

a first patch antenna for operation at a first frequency;

a second patch antenna for operation at a second frequency that is an integer multiple of said first frequency;

a dielectric support on which said first patch antenna and said second patch antenna are mounted, wherein a nearest distance between said first patch antenna and said second patch antenna is $(\lambda/2)/(\kappa)^{1/2}$, wherein λ is a wavelength of said second frequency and κ is a dielectric constant of said dielectric support, said dielectric support having a feed point adapted to have a transmission line electrically coupled thereto; and electrically-conducting paths coupled to said dielectric support for electrically coupling said feed point to said first patch antenna and said second patch antenna, at least one of said paths having an insertion loss that is greater than 0 dB and less than or equal to 3 dB.

2. A patch antenna as in claim 1, wherein at least one of said first patch antenna and said second patch antenna comprises a stacked patch antenna.

3. A patch antenna as in claim 1, wherein said first patch antenna and said second patch antenna lie in parallel planes.

4. A patch antenna as in claim 1, wherein said second patch antenna comprises a stack of patch antennas interleaved with said dielectric support, and wherein a single one of said patch antennas is electrically coupled to said paths.

5. A patch antenna, comprising:

a first patch antenna for operation at a first frequency;

a second patch antenna for operation at a second frequency that is an integer multiple of said first frequency;

multiple layers of a dielectric material for supporting said first patch antenna and said second patch antenna, wherein a distance between nearest edges of said first patch antenna and said second patch antenna is $(\lambda/2)/(\kappa)^{1/2}$, wherein $\lambda$ is a wavelength of said second frequency and $\kappa$ is a dielectric constant of said dielectric material, and wherein one of said layers supports a feed point adapted to have a transmission line electrically coupled thereto; and electrically-conducting paths coupled to said one of said layers for electrically coupling said feed point to said first patch antenna and said second patch antenna, at least one of said paths having an insertion loss that is greater than 0 dB and less than or equal to 3 dB.

6. A patch antenna as in claim 5, wherein at least one of said first patch antenna and said second patch antenna comprises a stacked patch antenna.

7. A patch antenna as in claim 5, wherein said first patch antenna and said second patch antenna lie in parallel planes.

8. A patch antenna as in claim 5, wherein said second patch antenna comprises a stack of patch antennas interleaved with a portion of said layers, and wherein a single one of said patch antennas is electrically coupled to said paths.

9. A patch antenna, comprising:

a first patch antenna for operation at a first frequency;

a second patch antenna for operation at a second frequency that is an integer multiple of said first frequency;

a dielectric support on which said first patch antenna and said second patch antenna are mounted in parallel planes, wherein a distance between nearest edges of said first patch antenna and said second patch antenna is $(\lambda/2)/(\kappa)^{1/2}$, wherein $\lambda$ is a wavelength of said second frequency and $\kappa$ is a dielectric constant of said dielectric support;

an RF feed point coupled to said dielectric support and adapted to have a transmission line electrically coupled thereto; and electrically-conducting paths coupled to said dielectric support for electrically coupling said feed point to said first patch antenna and said second patch antenna, at least one of said paths having an insertion loss that is greater than 0 dB and less than or equal to 3 dB.

10. A patch antenna as in claim 9, wherein at least one of said first patch antenna and said second patch antenna comprises a stacked patch antenna.

11. A patch antenna as in claim 9, wherein said dielectric support comprises multiple layers of a dielectric material.

12. A patch antenna as in claim 9, wherein said second patch antenna comprises a stack of patch antennas interleaved with said dielectric support, and wherein a single one of said patch antennas is electrically coupled to said paths.

* * * * *